US006772881B2

(12) United States Patent
Le et al.

(10) Patent No.: US 6,772,881 B2
(45) Date of Patent: Aug. 10, 2004

(54) REMOTE CONTROL COVER

(76) Inventors: Scott C. Le, 2613 Basswood Dr., Rowlett, TX (US) 75089; Quynh-Nhu Thi Tran, 2613 Basswood Dr., Rowlett, TX (US) 75089

( * ) Notice: Subject to any disclaimer, the term of this patent is extended or adjusted under 35 U.S.C. 154(b) by 86 days.

(21) Appl. No.: 10/206,064

(22) Filed: Jul. 29, 2002

(65) Prior Publication Data

US 2004/0016658 A1 Jan. 29, 2004

(51) Int. Cl.[7] ..... B65D 85/38; B65D 85/46; B65D 33/04; B65D 85/00

(52) U.S. Cl. ..... 206/305; 206/320; 383/106; 150/165

(58) Field of Search ..... 206/305, 320, 206/576, 776, 777, 778, 440; 150/154, 165; 383/106, 89, 119, 903, 107

(56) References Cited

U.S. PATENT DOCUMENTS

| | | | | | |
|---|---|---|---|---|---|
| 3,613,843 | A | * | 10/1971 | Davis | 206/292 |
| 4,762,227 | A | * | 8/1988 | Patterson | 206/320 |
| 4,836,256 | A | | 6/1989 | Meliconi | |
| 4,954,384 | A | * | 9/1990 | Hartwell | 428/100 |
| 5,092,459 | A | | 3/1992 | Uljanic et al. | |
| 5,388,692 | A | * | 2/1995 | Withrow et al. | 206/320 |
| 5,499,713 | A | | 3/1996 | Huffer | |
| 5,648,757 | A | * | 7/1997 | Vernace et al. | 340/539.32 |
| 5,873,456 | A | * | 2/1999 | Hull et al. | 206/38.1 |
| 6,050,407 | A | * | 4/2000 | Trujillo | 206/320 |
| 6,305,540 | B1 | * | 10/2001 | Crawford et al. | 206/320 |
| 6,543,864 | B2 | * | 4/2003 | Cline | 312/3 |
| 6,629,601 | B1 | * | 10/2003 | Russell | 206/315.3 |
| 2002/0175099 | A1 | * | 11/2002 | Wu | |
| 2003/0127345 | A1 | * | 7/2003 | Zuleta et al. | |

FOREIGN PATENT DOCUMENTS

| | | | |
|---|---|---|---|
| CA | 2110776 | * | 12/1993 |
| ZA | 9303404 | * | 1/1994 |

* cited by examiner

*Primary Examiner*—Jacob K. Ackun
*Assistant Examiner*—Faye Francis
(74) *Attorney, Agent, or Firm*—Richard C. Litman

(57) ABSTRACT

A remote control cover has a body, a plurality of window openings incorporated within the body, a closure flap at an open end of the body, and a closure flap with hook and loop fastening material for securing the flap in a closed position. The body has a pair of lateral seams that are reinforced with a pair of crimps. The remote control cover is generally flat when empty, but is flexible in order to conform to the shape of a remote control unit that is inserted in the cover.

14 Claims, 6 Drawing Sheets

REMOTE CONTROL COVER

BACKGROUND OF THE INVENTION

1. Field of the Invention

The present invention relates generally to protective covers for handheld electronic devices, and more particularly to remote control covers.

2. Description of the Related Art

There are a variety of different remote control covers on the market today. There are many differences among these covers, depending on the goals and equipment of the inventor. U.S. Pat. No. 4,836,256, issued to Loris Meliconi on Jun. 6, 1989, discloses a shockproof protective sheath for remote controls having a hollow cavity for the remote control, and a body of shock-absorbent material around the periphery.

U.S. Pat. No. 5,092,459, issued to Daniel Uljanic et al. on Mar. 3, 1992, discloses a transparent case with a number of deflectable pads corresponding to the buttons on an enclosed remote control unit.

A transparent remote control flexible envelope is disclosed in U.S. Pat. No. 5,499,713, issued to Richard Huffer on Mar. 19, 1996.

Among the problems with the remote control covers currently available is that they are manufactured to fit a particular size and shape of remote control unit. Within existing remote control covers there is little flexibility in the external dimensions or the keypad layout of the remote control unit that may be protected. If a remote control unit is significantly smaller than the protective cover, there may be little or no ability to adjust the protective cover to properly fit the remote control unit.

In addition, many of the prior art remote control covers are complex to manufacture. A complex protective cover is more costly to manufacture. Further, an unintentional design feature of some of the prior art remote control covers is that it is difficult to remove an enclosed remote control unit. The difficulty in removing an enclosed remote control unit makes it more difficult for the user to perform routine maintenance, like changing batteries.

None of the above inventions and patents, taken either singularly or in combination, is seen to describe the instant invention as claimed. Thus a remote control cover solving the aforementioned problems is desired.

SUMMARY OF THE INVENTION

The remote control cover of the present invention is a flat envelope of a flexible, water-resistant material formed from a single, elongated piece of water-resistant material. The flat shape is due to the method of construction. The material is folded across its width to form two lateral seams, an open end and a closed end. A closing flap is at the open end of the envelope. The closing flap is an extension of the single piece of material from the open end of the envelope, and is used to secure the remote control unit inside the envelope by a plurality of hook and loop fasteners attached to adjacent faces of the closing flap and the body. The closing flap is secured to the body of the remote control cover, and thus forms a cavity to contain a remote control unit within.

The remote control cover also has a keypad window and a signal window, to permit actuation of the remote controls unit's buttons and to permit remote control signals to pass through the remote control cover and reach the equipment to be remotely controlled. The plurality of windows also act as a part of the protection of the enclosed remote control unit from liquids and other hazards. The remote control cover further comprises a pair of reinforcing crimps at the closed end of the body. The crimps are adjacent to the fold of the body and reinforce the two lateral seams.

Accordingly, it is a principal object of the invention to introduce a remote control cover to protect the enclosed remote control unit from liquids and other hazards where the remote control unit is used.

It is another object of the invention to provide a remote control cover that is available in different sizes to accommodate the wide size range of remote control units on the market.

Still another object of the invention to introduce a remote control cover that is very easy to produce.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
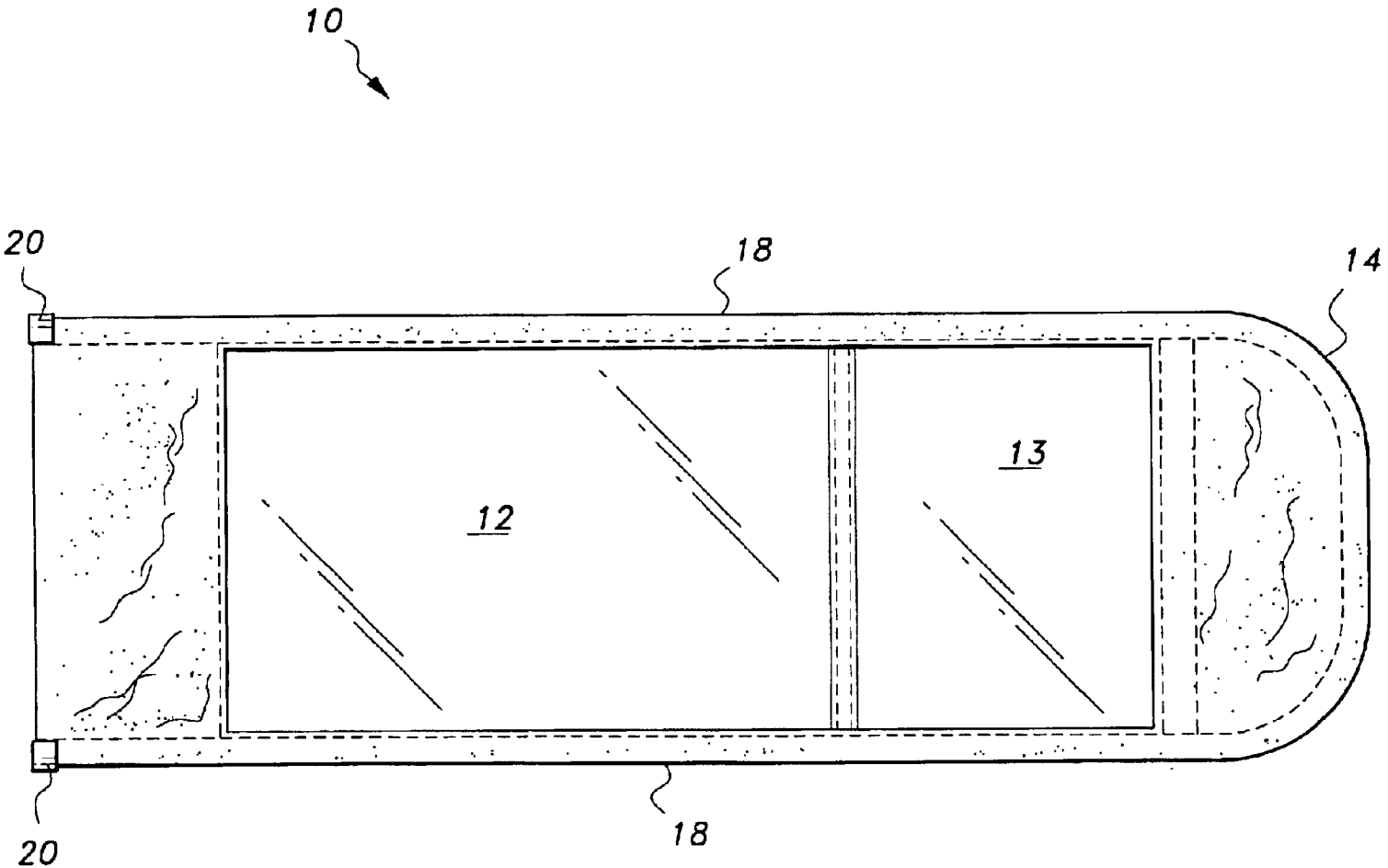
FIG. 1 is a front view of a remote control cover according to the present invention.
Figure 2:
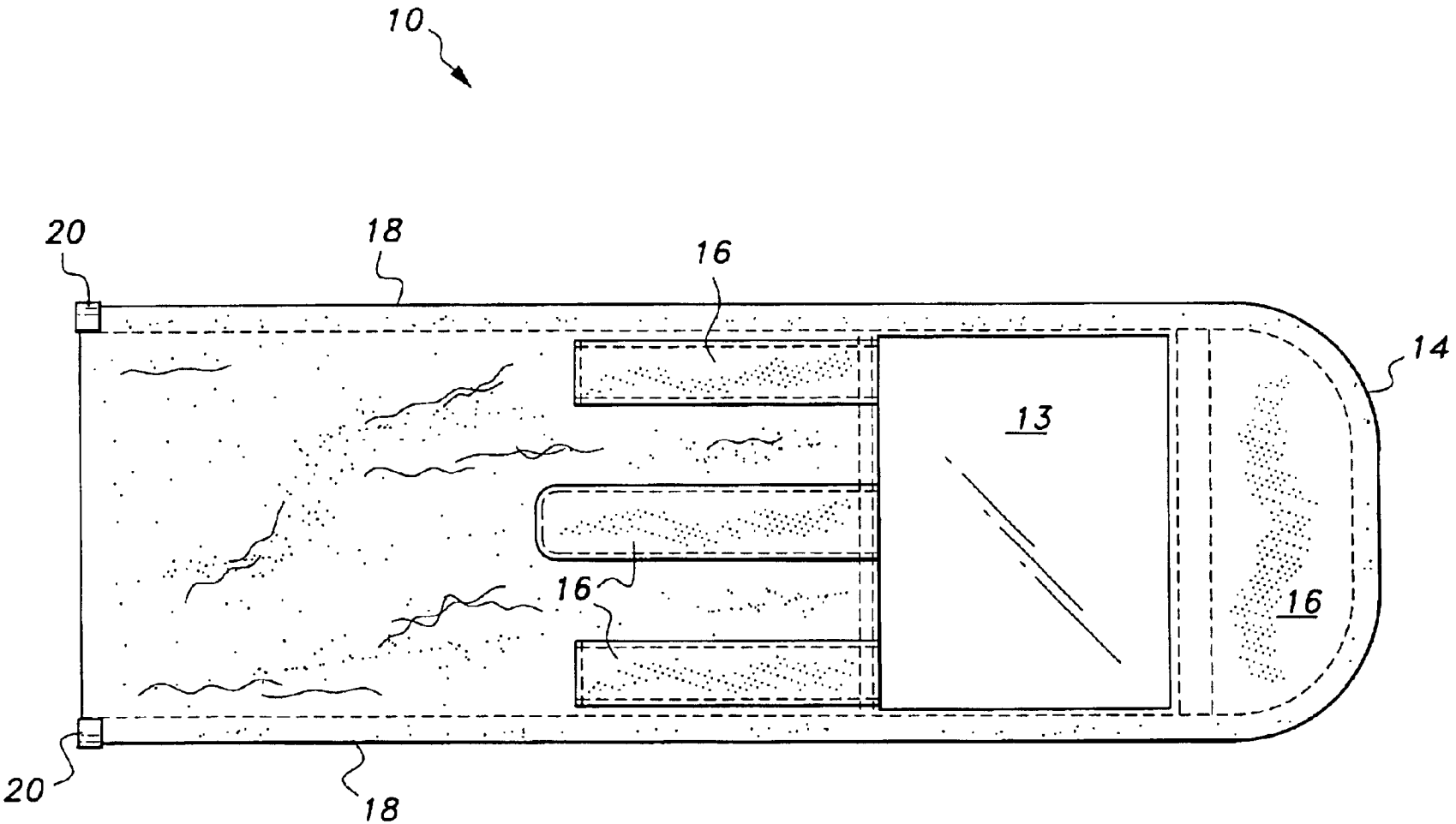
FIG. 2 is a rear view of a remote control cover according to the present invention.

The present invention is a remote control cover. As seen in FIG. 1, the remote control cover has comprises a body 10, a plurality of window openings 12 and 13 incorporated within the body 10, a closure flap 14 at an open end of the body 10, and a closure flap securing means 16, shown in FIG. 2, attached to the closure flap 14 and the body 10. The body 10 is substantially pouch-shaped. In one embodiment, the body 10 is assembled from a single piece of flexible material, such as vinyl or leather, that is folded to create a two-layer pouch. The flexible material is at least water-resistant. When a single piece of flexible material is used, the body 10 will have two lateral edges 18. The lateral edges 18 are seams formed from the convergence of the flexible material when it is folded upon itself to form a pouch. The seams are formed by sewing, glue, or by heat-welding. In another embodiment, the body 10 may be formed as a single piece, whereby the seams are formed as an integral part of the body 10 and no further mechanical attachment is required. In another embodiment, the lateral edges 18 are further secured and reinforced at a lower corner with a crimp 20. In the preferred embodiment, the crimp 20 may be a metallic or nonmetallic corner reinforcement.

In another embodiment, the plurality of window openings 12 and 13 numbers only two window openings. The plurality of window openings 12 and 13 are formed by a flexible and transparent material which extends over the entire window opening. As shown in FIG. 1, the preferred embodiment includes a keypad window 12 and a signal window 13. The keypad window 12 permits manipulation of the keypad on the remote control unit. The material used to form the keypad window 12 is transparent so that a user may see the buttons on the remote control unit. The material also is soft and flexible so that individual buttons may be selectively actuated. In one embodiment, the material is a sheet of plastic film. In another embodiment the plurality of windows 12 and 13 comprises a single window that performs the functions of both the keypad window 12 and the signal window 13.

The signal window 13 permits passage of control signals, e.g., the beam from an infrared light emitting diode, from the remote control unit. This is to ascertain that the remote control cover does not interfere with the normal functioning of the remote control unit. The signal window 13 is incorporated into an end of the body 10 of the remote control cover corresponding to the transmission source of the remote control unit when the remote control unit is within the body 10. The material used to form the signal window 13 is flexible so that the signal window 13 may wrap around and conform to the transmission source of the remote control unit, and preferably transparent to allow the infrared signal to pass through the window 13. In one embodiment the signal window 13 is a sheet of plastic film.

Figure 3:
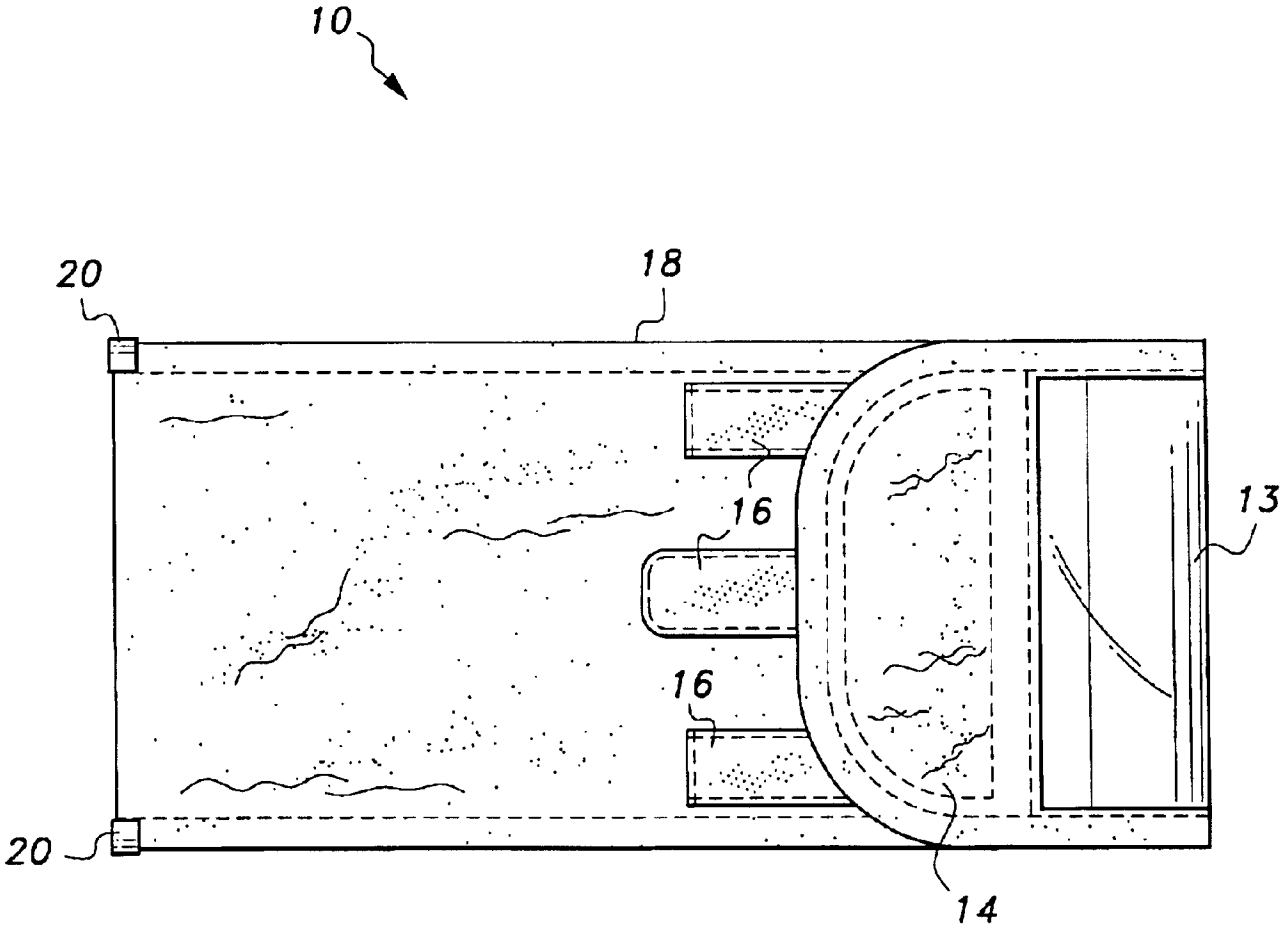
FIG. 3 is a rear view of a remote control cover with flap closure secured according to the present invention.

As shown in FIG. 3, the closure flap 14 extends from the open end of the body 10 of the remote control cover, from one of the two layers forming the body 10. A closure flap securing means 16 secures the closure flap 14 to the opposite layer of the body 10 of the remote control cover. In the secured position, the closure flap 14 extends across the open end of the body 10 of the remote control cover to form a closed cavity within the body 10 and secures the remote control unit within. In one embodiment, the closure flap securing means 16 is a plurality of hook and loop fasteners formed by mating strips of hook and loop fastening material. The hook and loop fasteners permit the user to continuously adjust the size of the cavity within the body 10 to securely retain a remote control unit in the cover, wherein the remote control unit may have a wide range of external dimensions. This capacity of the cover to adjust to remote control units of different lengths and thickness is enhanced by providing a plurality of elongated strips of hook and loop fastening material on the rear of the body 10, and by providing the flap 14 with a mating piece of hook and loop material which is both wide and elongated in order to provide a closure means with a long potential surface area of mating material. The plurality of hook and loop fasteners also permits the closure flap 14 to be secured along its entire width and not at just one spot. This has the advantages of improving the remote control cover's resistance to liquids and debris, and further reduces the incidence of snagging a partially secured closure flap 14. The closure flap securing means 16 also permits insertion and removal of the remote control unit into and out of the body 10 of the remote control cover quickly and easily.

Figure 4:
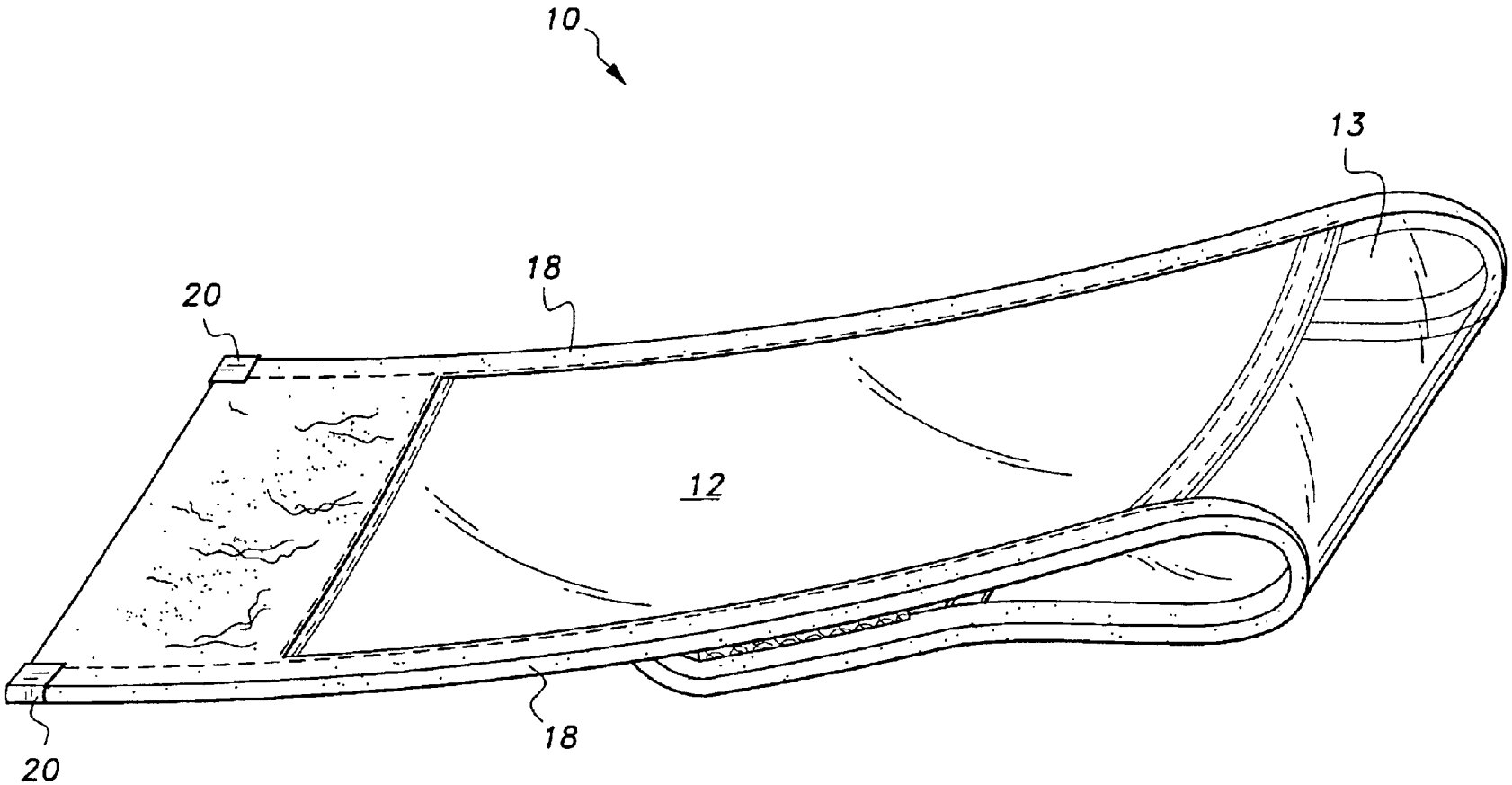
FIG. 4 is a perspective view of a remote control cover according to the present invention.

FIG. 4 discloses a perspective view of a remote control cover where the closure flap 14 is secured via the closure flap securing means 16 across the open end of the body 10 to form a cavity to contain a remote control unit.

Figure 5:
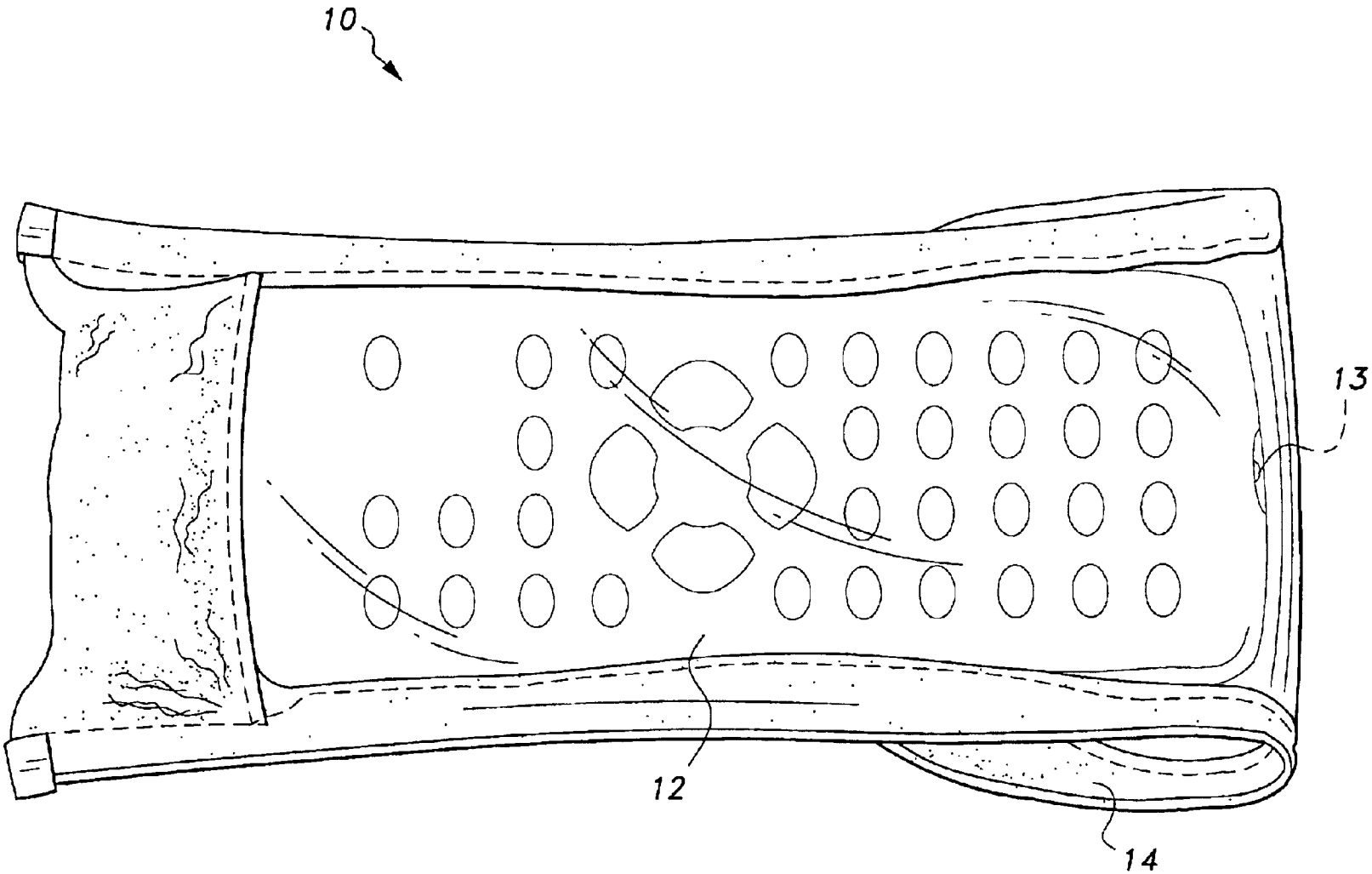
FIG. 5 is a front perspective view of a remote control cover enclosing a remote control unit according to the present invention.

FIG. 5 discloses a front perspective view of a remote control cover with an enclosed remote control unit. The remote control cover is substantially flat when empty. The closure flap 14 is secured to the body 10 of the remote control cover to firmly retain the remote control unit within. The plurality of windows 12 and 13 within the body 10 permit full access by the user to the keypad and for the transmission of control signals.

Figure 6:
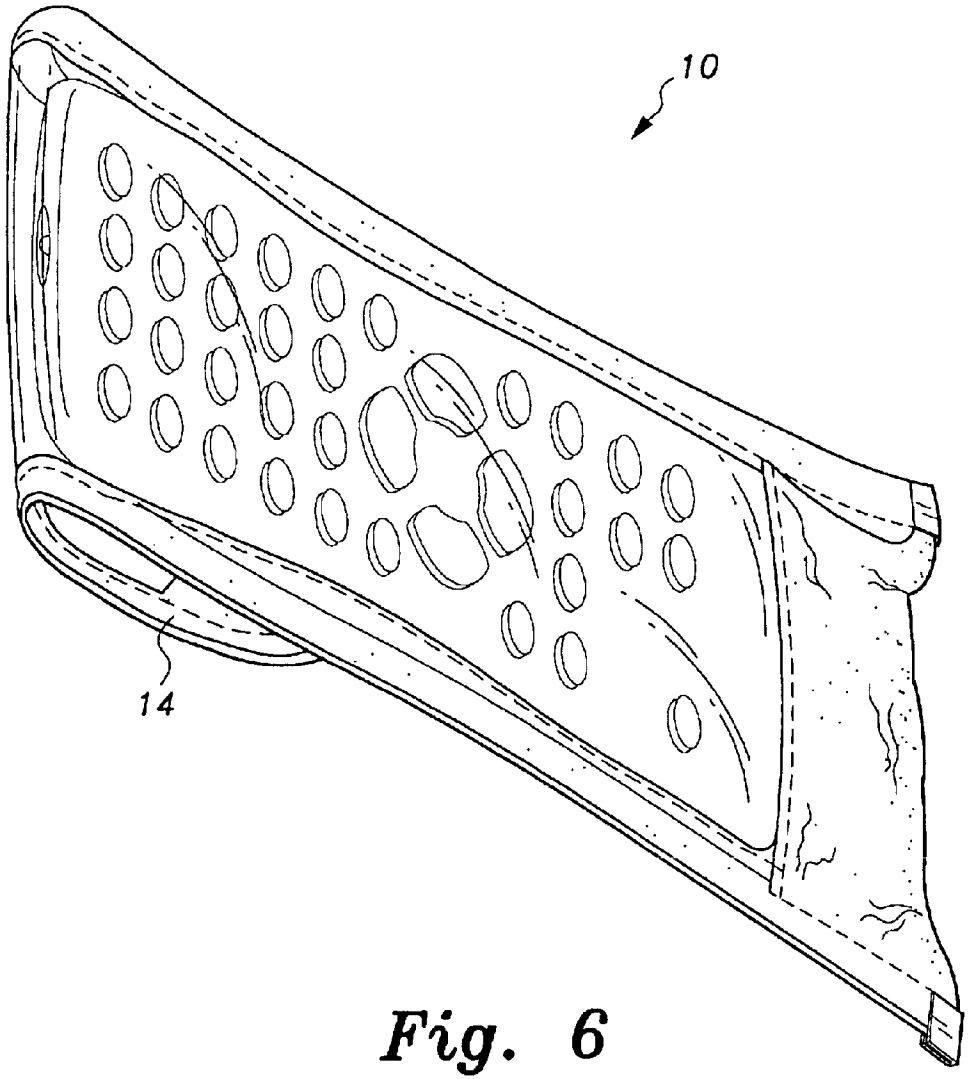
FIG. 6 is a perspective view of a remote control cover enclosing remote control unit according to the present invention.

FIG. 6 discloses a side perspective view of the remote control cover with an enclosed remote control unit. The closure flap 14 is secured to the body 10 to positively retain the remote control unit within. The body 10 of the remote control cover is flexible and deformable to accommodate remote control units of various sizes within. When the closure flap 14 is securely affixed to the body 10 using the closure flap securing means 16, the enclosed remote control unit is well protected from spills and other external hazards. The remote control cover may accommodate a wide range of remote control unit sizes and may also be manufactured in different sizes to accommodate remote control units that are unusually large or small.

It is to be understood that the present invention is not limited to the embodiments described above, but encompasses any and all embodiments within the scope of the following claims.

We claim:

1. A universal cover for remote control devices comprising:

a body designed and configured as a substantially flat envelope having a front side, a rear side, said front and rear sides defining a closed bottom end, closed lateral edges, an open top end, and a closure flap extending from said front side, adjacent to said open top end;

at least one window within the body; and a closure flap securing means attached to said closure flap and said rear side, said securing means designed and configured for closing the open end of the body by selectively securing said closure flap along said rear side;

wherein an adjustable cavity is defined within said envelope of said body.

2. The universal cover for remote control devices of claim 1, wherein the body is a flexible pouch.

3. The universal cover for remote control devices of claim 1, wherein the body is formed of a unitary piece of flexible material folded so as to form two layers.

4. The universal cover for remote control devices of claim 3, wherein said closed lateral edges of the body are formed by seams.

5. The universal cover for remote control devices of claim 4, further comprising a crimp securing each of the seams forming said lateral edges.

6. The universal cover for remote control devices of claim 1, wherein said at least one window includes a transparent and flexible keypad window and a transparent and flexible signal window.

7. The universal cover for remote control devices of claim 1, wherein said at least one window includes a signal window opening disposed adjacent the open end of the remote control cover, the signal window opening having a transparent layer of plastic film for permitting a control signal from the remote control unit to pass through the signal window opening.

8. The universal cover for remote control devices of claim 1, wherein said closure means including a plurality of strips of loop fastening material disposed on said rear side, and at least one strip of hook material disposed on said closure flap.

9. The universal cover for remote control devices of claim 1, wherein said closure means provides a continuously adjustable fastener for universally adjusting to remote control devices of varying thicknesses and lengths.

10. A universal cover for remote control devices, comprising:

a body made from a flexible, water-resistant material and having at least one fold and a pair of lateral edges forming a substantially flat structure defining a cavity, the body having an open end providing access to the cavity;

a plurality of window openings defined in said body, the plurality of window openings including a keypad window opening, and a signal window opening;

a continuous film of transparent, flexible material disposed over said keypad and signal window openings;

a closure flap disposed at the open end of said body; and closure flap securing means attached to the closure flap and said body for selectively closing the open end of said body;

wherein a remote control device is contained in said cavity.

11. The universal cover for remote control devices of claim 10, wherein the closure flap securing means is a plurality of mating strips of hook and loop fastening material.

12. The universal cover for remote control devices of claim 10, wherein the body is made from leather.

13. The universal cover for remote control devices of claim 10, wherein said fold forms a closed bottom opposite said open end, and a pair of seamed lateral edges extending from the closed bottom to the open end; and further comprising: a pair of corner reinforcements attached to said body at said closed bottom for reinforcing said pair of seamed lateral edges.

14. The universal cover for remote control cover devices of claim 1, wherein said closed bottom and said lateral edges define at least two corners; and further comprising a pair of reinforcements attached to said body at said at least two corners for reinforcing the lateral edges.

* * * * *